US005272419A

United States Patent [19]

Park

[11] Patent Number: 5,272,419

[45] Date of Patent: Dec. 21, 1993

[54] FLAT VISIBLE DISPLAY DEVICE AND METHOD OF FORMING A PICTURE

[75] Inventor: Cheolwoo Park, Kyunggi, Rep. of Korea

[73] Assignee: Samsung Electron Devices Co., Ltd., Kyunggi, Rep. of Korea

[21] Appl. No.: 889,982

[22] Filed: May 29, 1992

[30] Foreign Application Priority Data

Jun. 5, 1991 [KR] Rep. of Korea ..... 91-9338

[51] Int. Cl.[5] ..... G09G 3/10

[52] U.S. Cl. ..... 315/169.1; 313/422; 313/495; 313/302; 315/169.3; 345/10

[58] Field of Search ..... 315/169.1, 169.3, 366; 340/720; 313/448, 496, 423, 422, 495, 497, 302, 303, 293

[56] References Cited

U.S. PATENT DOCUMENTS 4,719,388 1/1988 Oess ..... 315/169.1
4,794,306 12/1988 Tischer et al. ..... 313/422
4,841,194 6/1989 Kishino et al. ..... 313/497

*Primary Examiner*—Robert J. Pascal
*Assistant Examiner*—Michael B. Shingleton
*Attorney, Agent, or Firm*—Watson, Cole, Grindle & Watson

[57] ABSTRACT

A flat, visible display device includes a backing plate and electrode, cathode wires extending parallel thereto, a face plate with a phosphorescent screen, an anode electrode, and an address plate with first and second addressing electrodes arranged in a crossing matrix pattern to selectively scan electrons. A first accelerating electrode is installed parallel to the same to form a thermal electron output section. Thermal electrons are accelerated to the electric field of the accelerating electrode to which a positive voltage is applied to form a space charge cloud of free electrons between the address plate and the accelerating electrode. The first and second addressing electrodes are selectively supplied with voltage to pass electrons through the apertures of the address plate to form a picture on the screen. The second addressing electrode is supplied with positive voltage, and backing and cut-off electrodes are supplied with a negative voltage to form a preliminary space charge cloud of free electrons. The second addressing electrode is supplied with zero voltage and the cut-off electrode is supplied with a positive voltage during blanking. The first addressing electrode is biased by zero volts or a negative potential for the space charge cloud to be moved to a thermal electron-generating section. After blanking, the cut-off electrode is supplied with negative voltage and at the same time, the second addressing electrode is supplied with a positive voltage to maintain the preliminary space charge cloud.

5 Claims, 2 Drawing Sheets

FLAT VISIBLE DISPLAY DEVICE AND METHOD OF FORMING A PICTURE

BACKGROUND OF THE INVENTION (1) Field of the Invention

The present invention relates to a flat visible display device and to a method of forming a picture using that device.

(2) Related Art

U.S. Pat. No. 4,719,388 contains a detailed description of visible display device. FIGS. 1 and 2 substantially conform to the figures of the same number as set forth in the aforesaid patent. The display device 100 of FIGS. 1 and 2 does not show external components such as a housing. The inside of display device 100 is maintained at a high vacuum atmosphere. In the construction of such a display device, a backing electrode 2 is located behind cathode wires 4 in a plane adjacent to, and parallel with, a backing plate 1 which may possibly provide support for the backing electrode. Bias voltage Vbe is applied to backing electrode 2.

Cathode wires 4 (more fully described with reference to FIG. 2) are disposed at a predetermined interval from the backing electrode 2 to be supplied with cathode voltage VK.

Accelerating electrodes 5 are arranged in a lattice configuration (see FIG. 2) are disposed at a predetermined interval from the cathode wires 4, so that an accelerating voltage Vacc can be applied thereto.

A face plate assembly 12 is disposed at the top and at the opposite end of the display device 100 from backing plate 1, and includes a face plate 11, a phosphorescent screen 10, and an anode electrode 9.

An anode voltage is, of course, applied to the anode electrode so that electrons impact on the phosphorescent screen 10, whereby a picture is displayed on the face side 11' of face plate 11.

An address plate 13, comprising a plurality of first and second addressing electrodes 6,8, respectively, orthogonally positioned with respect to substrate 7 of the address plate 13 (see FIG. 2), is interposed between the accelerator electrodes 5 and the face plate assembly 12. The first address electrodes 6 are shown extending in one direction on the one face of substrate 7 and second addressing electrodes 8 extend in a direction perpendicular thereto on the opposite face of the substrate 7. The first and second addressing electrode 6,8 is supplied with bias voltages Vfe,Vse, respectively.

During the operation of flat visible display device 100 constructed as described above, space-charge cloud of free electrons 3,3' is established as shown by the dotted line in FIG. 1.

During blanking of the display device, the cathode wires 4 are supplied with cathode voltage Vk to emit electrons. Thermal electrons are emitted to the backing plate 1 from a space-charge cloud of free electrons 3 induced by negative voltage applied to the backing electrode 2. Thermal electrons emitted to the accelerator electrode 5 establish a space-charge cloud 31 of free electrons between the address plate 13 and accelerating electrode 15.

The speed and direction of the space-charge cloud 3' of free electrons is controlled under the influence of the bias voltages vbe,Vk,Vfe,Vse.

The brightness of the screen is determined by the number of electrons striking the phosphor layer 10. However, a conventional flat visible display device has a short creation time of space-charge cloud 3' which corresponds to the blanking time, so that a sufficient number of electrons can not be obtained.

Furthermore, even with an efficient screen driving signal, a small number of electrons are emitted from the wire cathodes 4 because of the electric field effect. At that time, these electrons strike the phosphor layer 10 such that there is a higher brightness than that at its surroundings. Thus, in practice, non-uniform brightness of the line type corresponding to the cathode arrangement is formed on the screen.

SUMMARY OF THE INVENTION

An object of the present invention is to provide a flat visible display device wherein the duration of emitting thermal electrons from the wire cathodes are not restricted during the blanking of the screen so as to form a space-charge of sufficient free electrons and a small amount of electrons which are emitted from the cathode wires during driving the effective driving signal (fail to arrive at the screen) to improve the brightness and picture quality.

Another object of the present invention is to provide a method of forming a picture that is appropriate for a flat visible display device.

To achieve these objects, the present invention provides a flat visible display device having a backing plate and electrode, cathode wires disposed parallel to the backing plate and the electrode, an anode electrode, and a face plate having a phosphorescent screen forming a picture by electrons striking the screen. An address plate in which first and second addressing electrodes are arranged in an orthogonal crossing relationship to one another immediately adjacent the face and back side, respectively, of an apertured insulated substrate to selectively scan electrons. At a predetermined interval from the wire cathodes, a second accelerator electrode and cut-off electrode are successively disposed to form a thermal electron generating section. At a predetermined interval from the thermal electron generating section, a first accelerator electrode is installed parallel to the thermal electron-generating section to form a thermal electron outgoing section.

To effectively form a picture using the flat visible display device, the present invention uses a method of forming the picture in which the thermal electrons emitted from a cathode are accelerated to the electric field of an accelerator electrode to which a positive voltage is applied to form a space charge cloud of free electrons between an address plate and the accelerator electrode. A first and a second address electrode of the address plate are selectively supplied with voltage and thermal electrons pass through the selected holes of a plurality of apertures in an address plate to strike the phosphorescent screen, thereby forming a picture. The second accelerator electrode is supplied with a positive voltage and the backing and cut-off electrode are supplied with a negative voltage at the same voltage level to form a preliminary space-charge cloud of free electrons at the thermal electron-generating section. The second accelerating electrode is supplied with zero volt and the cut-off electrode is supplied with a positive voltage during blanking and the first accelerating electrode is biased by zero volt or a negative potential for the space-charge cloud of the thermal electron-generating section to be moved to a thermal electron outgoing section, whereby thermal electrons strike the phosphorescent screen of the face plate. After blanking, the cut-off electrode is supplied with a negative voltage and, simultaneously therewith, the first and second accelerating electrode are supplied with positive voltage to maintain the preliminary space-charge cloud forming at the thermal generating section.

BRIEF DESCRIPTION OF THE DRAWINGS

The above advantages, features and objects of the subject invention are believed to be apparent from a consideration of the following description of the best mode of carring out the invention when taken in conjunction with the following drawings, wherein.

DETAILED DESCRIPTION OF A PREFERRED EMBODIMENT

Figure 1:
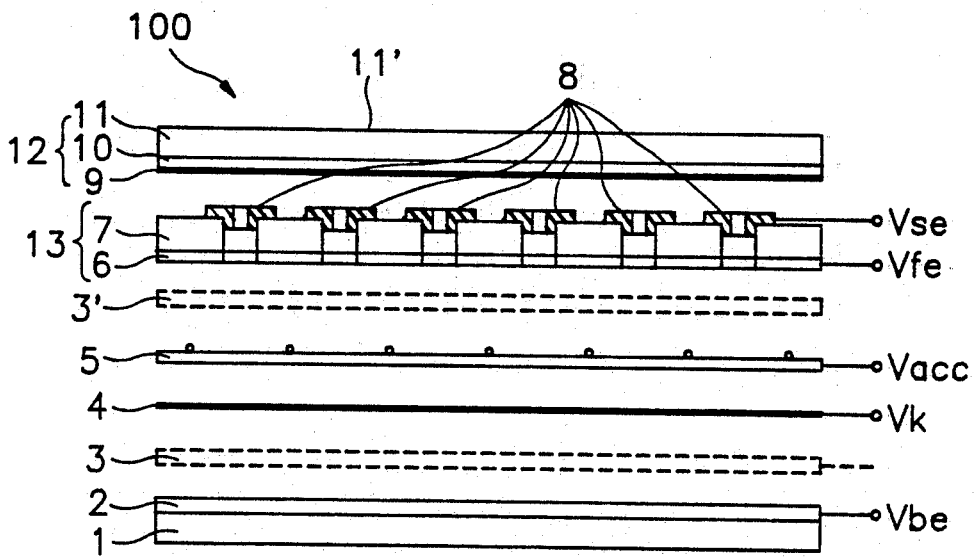
FIG. 1 (Prior Art)
FIG. 1 is a side elevation, diagrammatic view of a conventional flat, visible display device.
Figure 2:
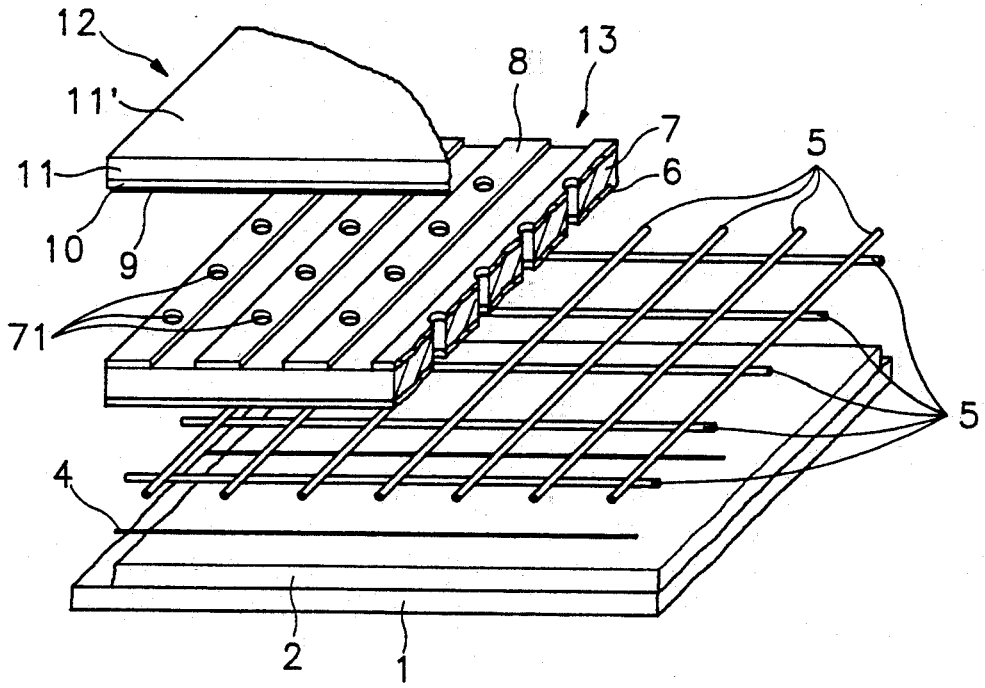
FIG. 2 (Prior Art)
FIG. 2 is a partially cut-away, exploded, perspective view of the display device of FIG. 1.
Figure 3:
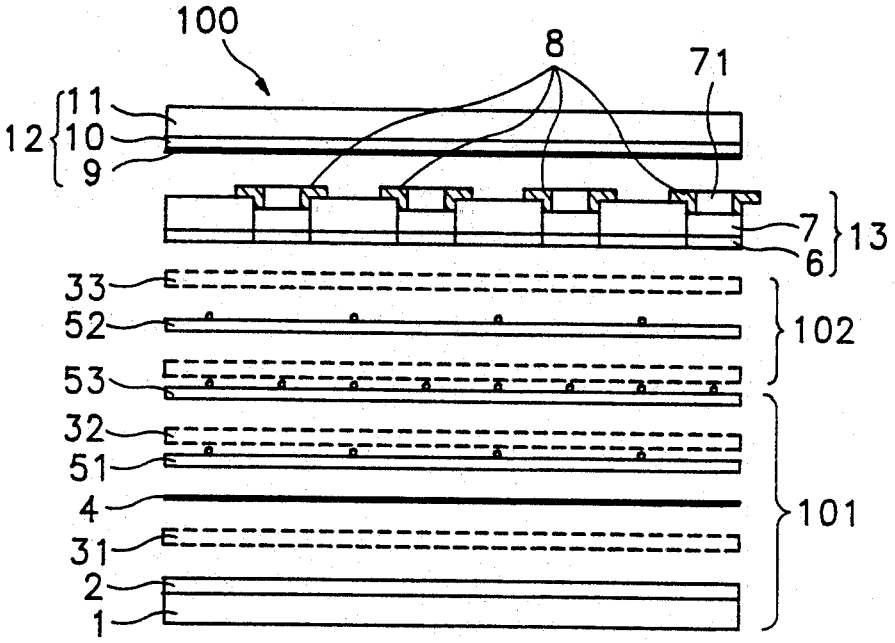
FIG. 3 is a diagrammatic, side elevation view of a flat, visible display device according to the present invention.

Identical components among all of the figures are denoted by the same numeral designation. As shown in FIG. 3, a flat visible display device 100 is provided with a backing plate 1, a backing electrode 2 and a cathode 4 disposed parallel to each other. A thermal electron generating section 101 is formed by successively disposing a second accelerating electrode 51 and cut-off electrode 53 which are space from cathode 4 in a manner known to those skilled in the art of flat visible display device. The second electrode 51 and cut-off electrode 53 are lattice-shaped electrodes, which result in high permeability of the electrons.

The lattice-shaped arrangement of the cut-off electrode 53 is denser than that of the second accelerating electrode 51. A positive voltage is applied to the second accelerating electrode 51 and a negative voltage is applied to a backing electrode 2 and the cut-off electrode 53, which is supplied with identical voltages. However, the voltage level is less than that of cathode 4 as is known to those skilled in the art of flat visible display devices.

Disposed immediately above the thermal electron generating section 101 is a first accelerating electrode 52 which functions to form a thermal electron outlet section 102 to produce electrons space-charge cloud 33.

A face plate structure 12 having a face plate 11, a phosphor layer 10 and an anode electrode 9 is formed conventionally disposed at the top of the display device 100 as shown in FIG. 3. The address plate 13 is interposed between the face plate assembly 12 and the first accelerating electrode 52.

The flat, visible display device according to FIG. 3 is formed such that the thermal electron-generating section 101 and the accelerating-electrode section 102 are provided with the lattice-shaped electrodes to allow the passage of electrons and are biased by a voltage which is applied to these electrodes and appropriately controlled to separate the operations of the thermal electrode-generating section 101 and the electron-accelerating assembly 102.

Thermal electrons emitted from the backing plate 1 form a space-charge cloud of free electrons 31 between the backing electrode 2 and cathode 4 under the influence of an electric field provided by a negative voltage applied to backing electrode 2. Also, thermal electron emitted from cathode 4 pass through the second accelerating electrode 51 and are accelerated to a much higher velocity than that induced by the backing electrode 2. However, after passing through the second accelerating electrode 51, the velocity of the thermal electrons is reduced to zero under the influence of electric field formed at the cut-off electrode 53 to which the higher voltage is applied than that applied to the cathode 4. The thermal electrons move backwardly guided by the second accelerating electrode 51.

The backwardly accelerating electrons pass through the second accelerating electrode 51 to be accelerated again and then speed is again reduced to zero. The electrons are then guided to the second accelerating electrode 51 in the manner of a pendulum so that the densest space-charge cloud of free electrons 32 is formed at the region where speed of the thermal electrons is zero between the second accelerating and cut-off electrode 51,53. The electron cloud is designated by a dotted line in FIG. 3.

During the blanking operation of the display device 100, a zero voltage is applied to the second accelerating electrode 51 and a positive voltage is applied to the cut-off electrode 53, so that thermal electrons which form the space-charge cloud of free electrons 32 are guided to the electric field of the first accelerating electrode 52 to which a positive voltage is applied so as to pass through the cut-off electrode 53, whereby the electrons move from the electron generating section 101 to the electron-accelerating section 102.

The first and second addressing electrode 6,8 which are arranged on opposite sides of a face flat 7 perpendicular to each other are selectively biased, so that thermal electrons forming the space-charge cloud 33 of free electrons are guided to an anode electrode 9 by passing through the selected holes of address plate 7 as determined by the first and second addressing electrode 6,8. Thermal electrons guided to the anode electrode 9 are accelerated and strike phosphor layer 10 with sufficient energy to emit light.

A convectional flat visible display device has the disadvantage that a small amount of electrons emitted from the wire cathodes influence the display on the screen by causing a non-uniform brightness of a line type due to the interfering effect of an electric field during operation of driving effective signals. However, in accordance with the present invention, the thermal electrons emitted from the wire cathodes pass through the thermal electron-generating and accelerating electrodes to overcome the above-mentioned problem. Also, the separated thermal electron-generating and accelerating electrodes prepare the space-charge cloud of free electrons, so that sufficient thermal electrons can be obtained to noticeably improve the brightness of the screen over that obtained in the method of operating a conventional flat, visible display device.

Further, the second accelerating electrode 51 is cut off by the cut-off electrode 53 which is not influenced by electric field formed at the other electrode, so that even though lower voltage is applied thereto, a desirable accelerating effect can be obtained. Thus, the method and apparatus of the present invention have the advantage of requring a lower driving voltage thereby reducing costs.

Figure 4:
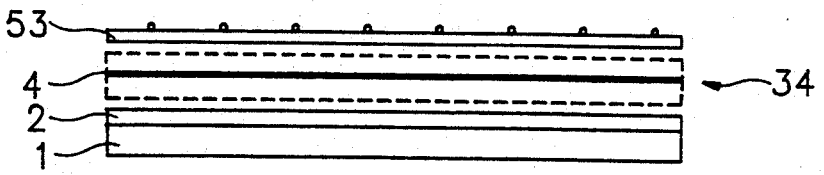
FIG.4 is a side view of another embodiment of a thermal electron generating section shown in FIG. 3.

FIG. 4 is a partial view of an other embodiment of the thermal electron-generating section of the present invention. In this embodiment, the second accelerating electrode 51 is omitted and the cut-off electrode 53 is only disposed following installation of the wire cathodes. The remaining structure is the same as described above. Moreover, in accordance with this embodiment because of the elimination of the second accelerating electrode 51, the electrode biasing is also simplified.

However, whereas the thermal electrons emitted from the wire cathode 4 are cut off under the influence of the electric field formed at the cut-off electrode 53 to form the space-charge cloud of free electrons 34 around the wire cathode 4, the density of the electron cloud 34 is somewhat high and the brightness obtained by the embodiment of FIG. 4 is not as great as that obtained with the embodiment of FIG. 3.

As described herein, the present invention separates the operation of the thermal electron generating and accelerating sections, so that better quality is achieved by removing non-uniform brightness of the line type appearing on the screen due to a small amount of electrons emitted from the wire cathodes.

Those skilled in the art of flat, visible display screens will recognize that modifications and alterations can be made to the invention as described herein, but it is not intended that the invention is to be limited to the specific structure described above, which description is merely to set forth the best mode of a preferred embodiment of the invention. The invention is to be limited by the attached claims and the equivalents to which the components thereof are entitled.

What is claimed is:

1. A flat visible display device comprising:

a backing plate and electrode;

cathode wires disposed parallel to said backing plate and electrode;

a face plate having a phosphorescent screen forming visible images in accordance with the pattern of electrons striking the screen;

an anode disposed parallel to said face plate;

an address plate including an apertured substrate and, first and second addressing electrodes arranged respectively in a crossing pattern with respect to one another at the face and back side, respectively of said insulated apertured substrate for selectively directing electrons to said screen;

a second accelerating electrode and a cut-off electrode are successively spaced from the wire cathodes to form a thermal electron-generating section; and a first accelerating electrode parallel to the thermal electron-generating section and spaced therefrom to form a thermal electron output section.

2. The display device as claimed in claim 1, wherein said second accelerating electrode is grid-shaped.

3. The display device as claimed in claim 1, wherein said cut-off electrode and said accelerating electrodes are a denser grid-shaped electrode than said accelerating electrode.

4. The display device as claimed in claim 1, wherein said second accelerating electrode and said cut-off electrode are at zero volt to enable a space-charge cloud of free electrons to move from said thermal electron generating assembly to the thermal electron output during blanking operation; said first accelerating electrode is biased at zero volt or a negative potential; and the cut-off electrode is biased at a negative voltage and said second accelerating electrode is at a positive voltage after blanking operation.

5. A method of forming a visible image in a flat visible display device having a backing plate and electrode, cathode wires disposed parallel to said backing plate and electrode, a face plate having a phosphorescent screen for forming visible images thereon, an anode disposed parallel to said face plate, an address plate including an apertured substrate, and first and second addressing electrodes, a second accelerating electrode and a cut-off electrode being successively spaced from the wire cathodes, and a first accelerating electrode parallel to the thermal electron-generating section and spaced therefrom, said method comprising the steps of:

accelerating thermal electrons emitted from said cathode wires by the electric field of said first accelerating electrode biased at a positive voltage to form a space charge cloud of free electrons between said address plate and said first accelerating electrode;

selectively supplying image-forming voltages to respective first and second address electrodes to determine the passage of thermal electrons through the apertures of a plurality of apertured address plates to strike said phosphorescent screen thereby forming a sequence of pictures thereon;

supplying a positive voltage to said second accelerating electrode;

supplying a negative voltage to said backing and cut-off electrodes to form a preliminary space-charge cloud of free electrons between said address plate and said first accelerating electrode;

supplying said second accelerating electrode with zero voltage and supplying said cut-off electrode with a positive voltage during blanking and said first accelerating electrode is biased at zero voltage or a negative potential to enable the space-charge cloud of free electrons to move to a thermal electron output whereby thermal electrons strike said image screen; and after blanking, supplying said cut-off electrode with a negative voltage and simultaneously supplying said second accelerating electrode with a positive voltage to maintain said preliminary space-charge cloud formed at said thermal electron generating section.

* * * * *